US008714848B2

(12) United States Patent
Torimaru et al.

(10) Patent No.: US 8,714,848 B2
(45) Date of Patent: May 6, 2014

(54) CONVEYANCE MECHANISM FOR IMAGE FORMING APPARATUS WITH SWITCHABLE STORE AND DISCHARGE SECTIONS

(75) Inventors: Satoru Torimaru, Kirishima (JP); Atsuyuki Kitamura, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 472 days.

(21) Appl. No.: 12/711,877

(22) Filed: Feb. 24, 2010

(65) Prior Publication Data

US 2011/0013961 A1 Jan. 20, 2011

(30) Foreign Application Priority Data

Jul. 14, 2009 (JP) ..... 2009-165665

(51) Int. Cl.
*B41J 13/00* (2006.01)
*B41J 3/60* (2006.01)
*H04N 1/04* (2006.01)

(52) U.S. Cl.
USPC ..... 400/188; 400/624; 400/629; 400/646; 358/498; 271/3.14

(58) Field of Classification Search
CPC ..... B41J 13/0009; H04N 1/0032; H04N 1/00596; G03G 2215/00928
USPC ..... 271/3.14; 399/498; 400/188, 624, 629, 400/646; 358/498
See application file for complete search history.

(56) References Cited

U.S. PATENT DOCUMENTS 5,567,068 A * 10/1996 Egashira et al. ..... 400/625
5,712,676 A * 1/1998 Takaki et al. ..... 347/262
5,790,279 A * 8/1998 Sakellaropoulos ..... 358/498
5,982,510 A 11/1999 Funahashi
7,403,739 B2 * 7/2008 Hwang ..... 399/391
8,104,981 B2 * 1/2012 Huang ..... 400/629
2005/0225623 A1 * 10/2005 Hsieh et al. ..... 347/104
2008/0231920 A1 * 9/2008 Oh ..... 358/496
2009/0074490 A1 * 3/2009 Shoji et al. ..... 399/374

FOREIGN PATENT DOCUMENTS

JP 63262351 A * 10/1988 ..... B65H 3/44
JP H07-143279 A 6/1995
JP 07-267413 A 10/1995
JP H07-330182 A 12/1995
JP 08-268620 A 10/1996
JP H10-35049 A 2/1998
JP 11187194 A * 7/1999 ..... H04N 1/00
JP 2006016201 A * 1/2006 ..... B65H 3/44
JP 2008063086 A * 3/2008 ..... B65H 3/44

OTHER PUBLICATIONS

Japanese Office Action issued in corresponding JP Patent Application No. 2009-165665 dated Jul. 30, 2013.

* cited by examiner

*Primary Examiner* — Daniel J Colilla
(74) *Attorney, Agent, or Firm* — Sughrue Mion, PLLC

(57) ABSTRACT

A conveyance mechanism includes a first conveyed material storage section and a second conveyed material storage section that respectively store a first conveyed material and a second conveyed material. When a position of the first conveyed material storage section is changed to a conveyed position where the first conveyed material is to be conveyed, a discharge destination of a discharge member is switched to a first conveyed material discharge section. When the position of the first conveyed material storage section is changed to an evacuation position evacuated from the conveyed position, the discharge destination of the discharge member is switched to a second conveyed material discharge section.

13 Claims, 6 Drawing Sheets

CONVEYANCE MECHANISM FOR IMAGE FORMING APPARATUS WITH SWITCHABLE STORE AND DISCHARGE SECTIONS

CROSS-REFERENCE TO RELATED APPLICATION

This application is based on and claims priority under 35 USC 119 from Japanese Patent Application No. 2009-165665 filed on Jul. 14, 2009.

BACKGROUND OF THE INVENTION

Field of the Invention

The invention relates to a conveyance mechanism and an image forming apparatus.

SUMMARY OF THE INVENTION

A conveyance mechanism according to a first aspect of the invention, includes: a first conveyed material storage section that stores a first conveyed material and is adapted to change a position thereof; a second conveyed material storage section that stores a second conveyed material; a first conveyed material discharge section that discharges the first conveyed material; a second conveyed material discharge section that discharges the second conveyed material; a conveyance section that conveys the first conveyed material from the first conveyed material storage section to the first conveyed material discharge section and conveys the second conveyed material from the second conveyed material storage section to the second conveyed material discharge section; a discharge member that is provided at the downstream side in a conveyance direction of a common conveyance path for the first conveyed material and the second conveyed material in the conveyance section, and is adapted to discharge the first conveyed material and the second conveyed material conveyed by the conveyance section to the first conveyed material discharge section or the second conveyed material discharge section; and a discharge destination switching member that, when a position of the first conveyed material storage section is changed to a conveyed position where the first conveyed material is to be conveyed by the conveyance section, switches a discharge destination of the discharge member to the first conveyed material discharge section and, when the position of the first conveyed material storage section is changed to an evacuation position evacuated from the conveyed position, switches the discharge destination of the discharge member to the second conveyed material discharge section.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the present invention will be described with reference to the accompanying drawings.

Figure 1:
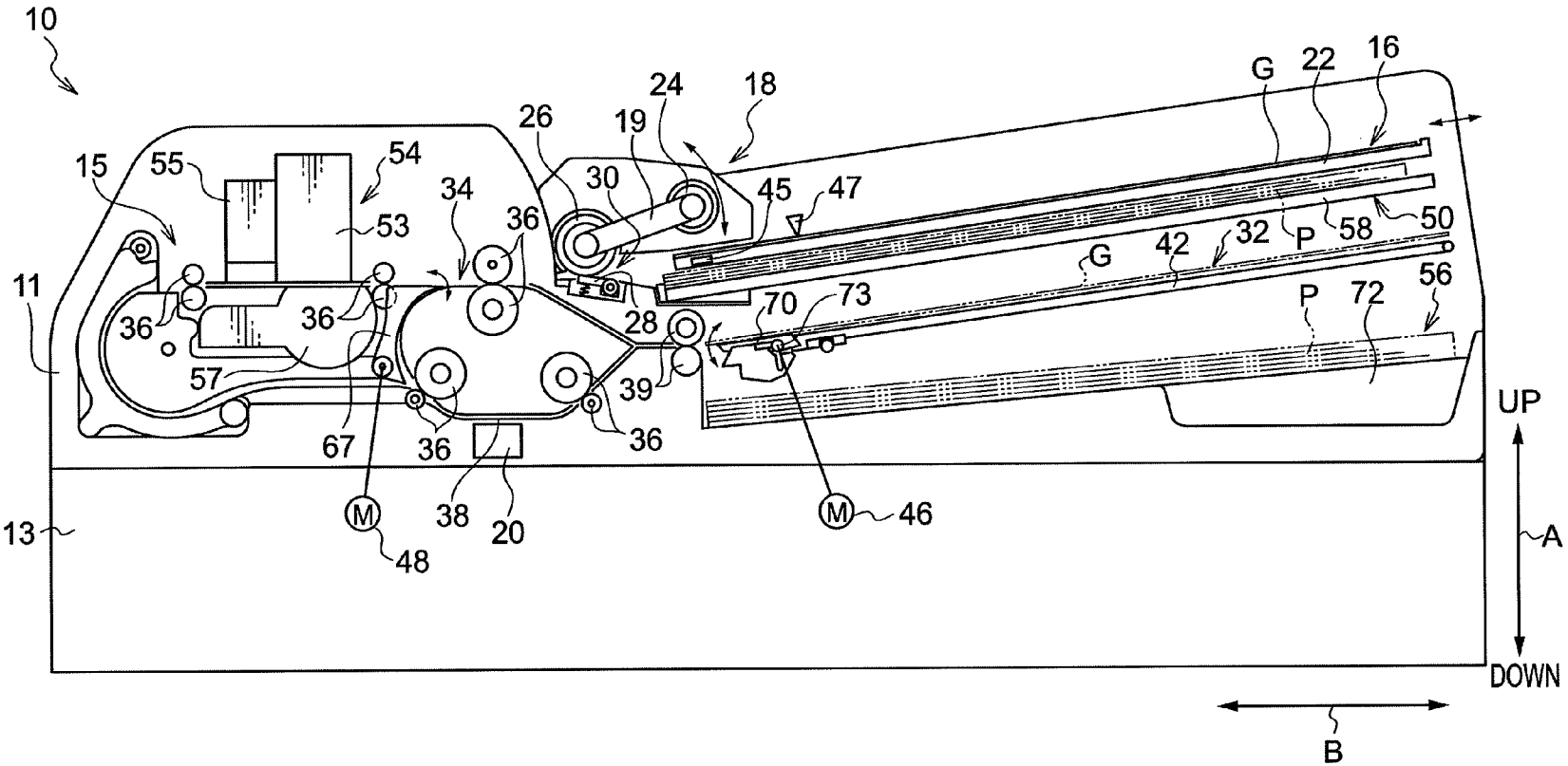
FIG. 1 is a schematic diagram illustrating the configuration of an image forming apparatus according to an exemplary embodiment of the present invention.
Figure 2:
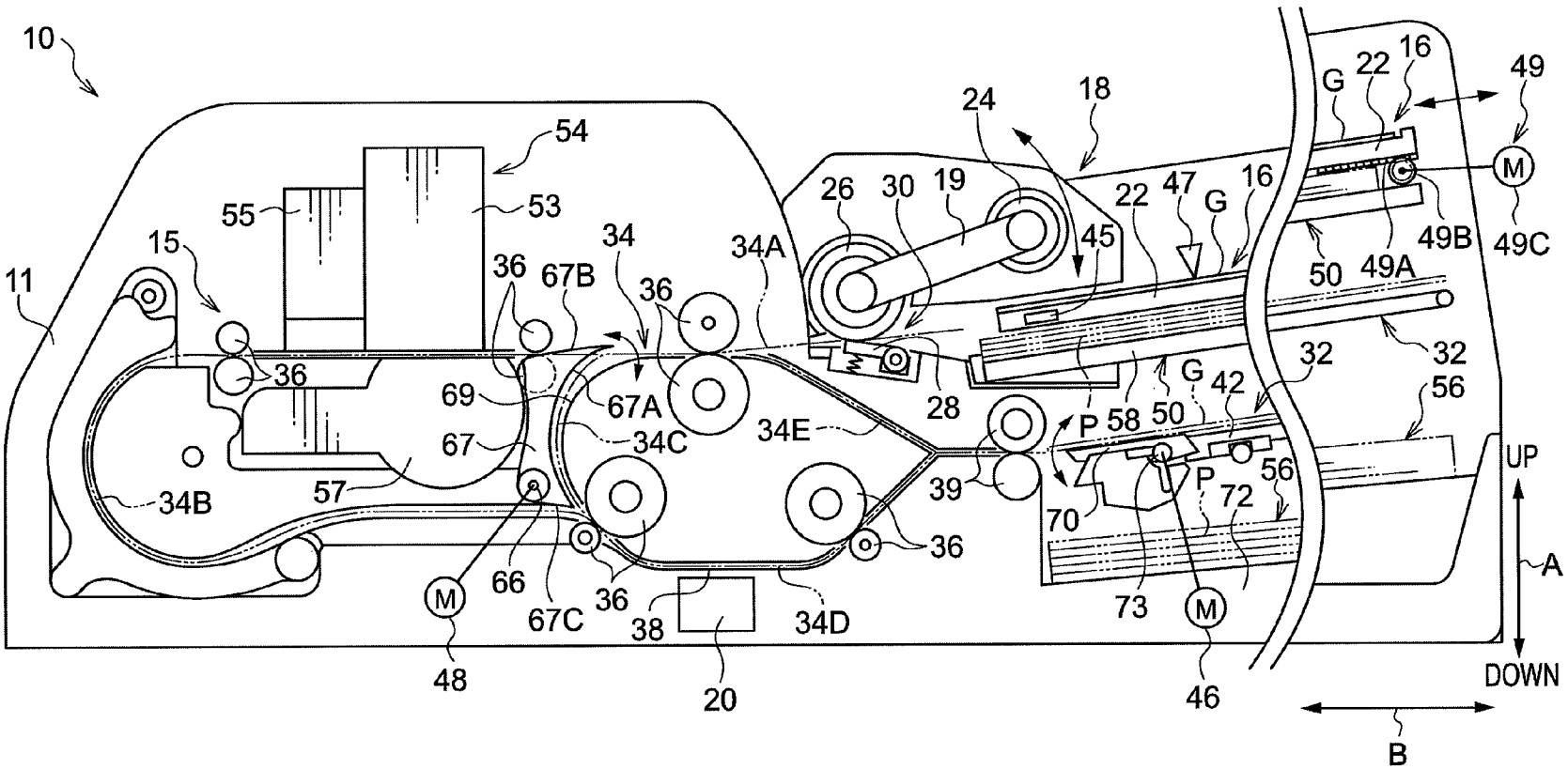
FIG. 2 is a schematic enlarged view of a portion of the image forming apparatus according to the exemplary embodiment of the present invention.

Configuration of an Image Forming Apparatus According to the Exemplary Embodiment First, the configuration of the image forming apparatus according to this exemplary embodiment will be described. FIGS. 1 and 2 schematically illustrate the configuration of the image forming apparatus according to this exemplary embodiment. In FIGS. 1 and 2, a vertical direction of the image forming apparatus is illustrated by an arrow A and a horizontal direction thereof is illustrated by an arrow B. These directions can be relatively changed according to an arrangement direction of an image forming apparatus 10, and are not limited to the case where the image forming apparatus is disposed with the directions illustrated by the arrows A and B, which are respectively defined as the vertical direction and the horizontal direction.

As illustrated in FIG. 1, the image forming apparatus 10 according to this exemplary embodiment includes an apparatus body 11 and a support body 13 that supports the apparatus body 11. The apparatus body 11 has a conveyance mechanism 15 that conveys an original G serving as an example of a first conveyed material and a recording medium P serving as a second conveyed material. The original G and the recording medium P may be paper or a film of plastic, metal or the like.

The first conveyed material is not limited to the original G. For example, the first conveyed material may be the recording medium P and any object that can be conveyed by the conveyance mechanism 15. The second conveyed material is not limited to the recording medium P. For example, the second conveyed material may be the original G and any object that can be conveyed by the conveyance mechanism 15.

The conveyance mechanism 15 includes an original storage section 16 serving as an example of a first conveyed material storage section, the position of which is made changeable, and stores the original a recording medium storage section 50 serving as an example of a second conveyed material storage section that stores the recording medium P, an original discharge section 32 serving as an example of a first conveyed material discharge section that discharges the original G, a recording medium discharge section 56 serving as an example of a second conveyed material discharge section that discharges the recording medium P, and a conveyance section 18 that conveys the original G from the original storage section 16 to the original discharge section 32 and conveys the recording medium P from the recording medium storage section 50 to the recording medium discharge section 56.

The original storage section 16, the original discharge section 32, the recording medium storage section 50, and the recording medium discharge section 56 are disposed at one side (right side of FIG. 1) of the apparatus body 11. Specifically, the original storage section 16, the original discharge section 32, the recording medium storage section 50, and the recording medium discharge section 56 are arranged along the vertical direction and overlap each other in the vertical direction, at one side (right side of FIG. 1) of the apparatus body 11. The original storage section 16, the recording medium storage section 50, the original discharge section 32, and the recording medium discharge section 56 are sequentially disposed in this order from the upper side. As such, the original storage section 16, the recording medium storage section 50, the original discharge section 32, and the recording medium discharge section 56 are disposed to be integrated at one side (right side of FIG. 1).

The original storage section 16 includes a placing platen 22, on which the original G fed by a feed roll 24 is placed. In the placing platen 22, the original G is placed along a feed direction with a read surface to be read being directed in an upward direction and stored in the original storage section 16. The placing platen 22 is inclined to have a descendent gradient in the feed direction of the original G.

The original storage section 16 is mounted in the apparatus body 11 so as to be slidable along the feed direction of the original G. The feed roll 24 is configured to rotationally move as described in detail below. The original storage section 16 positions the original G on a movement track of the feed roll 24, slides between a contactable position (refer to FIGS. 4 and 5) where the feed roll 24 can contact the original G and an evacuation position (refer to FIGS. 3 and 6) where the feed roll 24 evacuates into a position deviated from the movement track, and can change its position. The contactable position is a conveyed position where the original G is conveyed by the conveyance section 18, and the evacuation position is a position that is evacuated from the contactable position.

In the original storage section 16, a detector 47 that detects whether or not the original G is stored in the original storage section 16 is provided. As the detector 47, a reflective optical sensor (proximity switch) is used. The reflective optical sensor irradiates light onto a position of the original storage section 16 where the original G is stored, detects reflection light reflected on the original G, when the original G is stored in the original storage section 16, and detects whether or not the original G is stored in the original storage section 16. As the detector 47, a sensor having the different configuration may be used, instead of the reflective optical sensor.

As illustrated in FIG. 2, in the original storage section 16 (specifically, placing platen 22), a movement mechanism 49 that moves the original storage section 16 to the contactable position and the evacuation position on the basis of the detection result of the detector 47 is provided. The movement mechanism 49 includes a rack 49A that is formed on the placing platen 22 of the original storage section 16, a pinion 49B that is engaged with the rack 49A, and a driving motor 49C that drives and rotates the pinion 49B.

According to this configuration, if the detector 47 detects that the original G is stored in the original storage section 16, on the basis of the detection result, the movement mechanism 49 rotates the pinion 49B in one direction by the driving motor 49C, and moves the placing platen 22 where the rack 49A is formed to the contactable position along the feed direction of the original G.

If the detector 47 detects that the original G is not stored in the original storage section 16, on the basis of the detection result, the movement mechanism 49 rotates the pinion 49B in the other direction by the driving motor 49C, and moves the placing platen 22 where the rack 49A is formed to the evacuation position toward the rear side in the feed direction of the original G.

The configuration of the movement mechanism 49 is not limited to the above configuration. For example, the movement mechanism 49 may use a linear actuator, and may use an actuator having the configuration other than the above configuration, as long as a corresponding mechanism can move the original storage section 16 to the contactable position and the evacuation position.

The movement direction of the original storage section 16 is not limited to the above direction. For example, the original storage section 16 may move in a direction crossing the feed direction. The movement of the original storage section 16 is not limited to the slide movement, and may be, for example, rotational movement. In the configuration of the original storage section 16 that rotationally moves, the original storage section 16 may rotate such that an end of the original storage section 16 at a feed direction side of the original G is rotatively supported and lifts an end of the original storage section 16 at a feed direction rear side using the end as the rotation center.

The original storage section 16 may be configured such that the position thereof changes to three or more positions, rather than to just the two positions described above.

The recording medium storage section 50 includes a placing platen 58 upon which the recording medium P fed by the feed roll 24 is placed. In the placing platen 58, the recording media P are placed along the feed direction and are stored in the recording medium storage section 50. The placing platen 58 is inclined to have a descendant gradient in the feed direction of the recording medium P. The recording medium storage section 50 may be integrated with the original storage section 16.

The original discharge section 32 includes a placing platen 42 upon which the original G discharged by a discharge roll 39 is placed. In the placing platen 42, a read surface thereof is oriented in a downward direction, and the original G is placed along a discharge direction and stored in the original discharge section 32.

The recording medium discharge section 56 includes a placing platen 72 upon which the recording medium P discharged by the discharge roll 39 is placed. In the placing platen 72, the recording media P are arranged along a discharge direction and are stored in the recording medium discharge section 56. The recording medium discharge section 56 may be integrated with the original discharge section 32.

In the above configuration, the discharge section that is disposed on the recording medium discharge section 56 is the original discharge section 32. However, the original discharge section 32 may be used as the recording medium discharge section and the recording medium discharge section 56 may be used as the original discharge section. In this case, a discharge destination switching operation of a discharge destination switching member 70 to be described in detail below is reversed, the original G is discharged to the original discharge section at the lower side, and the recording medium P is discharged to the recording medium discharge section at the upper side.

In the above configuration, the storage section that is disposed on the upper side of the recording medium storage section 50 serves as the original storage section 16. However, the configuration where the original storage section 16 serves as the recording medium storage section and the recording medium storage section 50 serves as the original storage section may be adopted.

In this case, the detector 47 is provided with respect to the original storage section that is disposed below the recording medium storage section. If the detector 47 detects that the original G is stored in the original storage section, the recording medium storage section moves to the evacuation position deviated from the movement track of the feed roll 24 by the movement mechanism 49. If the detector 47 detects that the original G is not stored in the original storage section 16, the recording medium storage section moves to the contactable position where the feed roll 24 can contact the recording medium P, by the movement mechanism 49.

The configuration where the original storage section 16 serves as the recording medium storage section to store the recording medium P and the original discharge section 32 serves as the recording medium discharge section to discharge the recording medium P may be adopted. In this case, the recording medium storage section 50 may be used to store recording media having different sizes or kinds and convey the recording media. In this configuration, it becomes unnecessary to provide an original conveyance path 34C and an image reading unit 20 to be described in detail below.

The configuration where the recording medium storage section 50 serves as the original storage section to store the original G and the recording medium discharge section 56 serves as the original discharge section to discharge the original G may be adopted. In this case, the original storage section 16 may be used to store the originals G having different sizes or kinds and convey the originals G. In this configuration, a recording medium conveyance path 34B and an image forming unit 54 to be described in detail below do not need to be provided.

The recording medium storage section 50 may be disposed to be shifted from the original storage section 16, the original discharge section 32 may be disposed to be shifted from the recording medium storage section 50, and the recording medium discharge section 56 may be disposed to be shifted from the original discharge section 32. The shifted directions include a direction along the feed direction and a direction crossing the feed direction.

Accordingly, the recording medium storage section 50, the original discharge section 32, and the recording medium discharge section 56 may be respectively shifted in one direction from the original storage section 16, the recording medium storage section 50, and the original discharge section 32 which are disposed at the upper side, respectively, and the original storage section 16, the recording medium storage section 50, the original discharge section 32, and the recording medium discharge section 56 may be disposed in a staircase pattern.

Thereby, the storage of the original G, the refilling of the recording medium P, and the extraction of the original G and the recording medium P after the discharge may be easily handled.

The conveyance section 18 includes a feed roll 24 that can feed the originals G stored in the original storage section 16 from the original storage section 16 and feed the recording media P stored in the recording medium storage section 50 from the recording medium storage section 50, a separation mechanism 30 that separates each of the originals G or the recording media P fed by the feed roll 24, and plural conveyance rolls 36 that convey the originals G or the recording media P separated by the separation mechanism 30 to the original discharge section 32 or the recording medium discharge section 56.

The feed roll 24 is rotatively connected to the other end of a connecting member 19 that has one end rotatively connected to a rotation shaft of the conveyance roll 26 constituting a portion of the separation mechanism 30. When one end of the connecting member 19 is used as the rotation center and the other end rotates, and the original storage section 16 is posited at the contactable position, the feed roll 24 can rotationally move between the contact position with the original G stored in the original storage section 16 and a separation position which is away from the original G.

When the original storage section 16 is positioned at the evacuation position, the feed roll 24 can rotatively move between a contact position with the recording medium P stored in the recording medium storage section 50 and a separation position separated from the recording medium P.

The feed roll 24 is configured such that a force toward the separation position is always applied thereto by an elastic force of an elastic member (not illustrated), such as a spring, and a rotation force of the conveyance roll 26 causes the other end of the connecting member 19 to rotate about one end as the rotation center against the elastic force of the elastic member, thereby moving the feed roll 24 to the contact position. The configuration where the feed roll 24 is moved to the contact position or the separation position using a driving force of a driving section independent from the conveyance roll 26 or the configuration where the feed roll 24 is moved to the contact position using the weight of the feed roll 24 or the elastic force of the elastic member, such as the spring, may be adopted.

A conveyance path 34 along which the original G and the recording medium P fed by the feed roll 24 are conveyed is formed in the apparatus body 11. As illustrated in FIG. 2, the conveyance path 34 includes a first common path 34A along which the original G and the recording medium P fed by the feed roll 24 are commonly conveyed, a recording medium conveyance path 34B along which the recording medium P conveyed along the first common path 34A is conveyed, an original conveyance path 34C along which the original G conveyed along the first common path 34A is conveyed, a second common path 34D along which the recording medium P conveyed along the recording medium conveyance path 34B and the original G conveyed along the original conveyance path 34C are commonly conveyed, and a reversion path 34E that is used to reverse the original G and the recording medium P conveyed along the second common path 34D and return the original G and the recording medium P to the first common path 34A.

The recording medium conveyance path 34B and the original conveyance path 34C are configured such that at least portions are curved in a U shape, and the conveyance direction of the downstream end side is opposite to the conveyance direction of the upstream end side to cause the conveying direction of the conveyed original G and recording medium P to be turned back.

By the above configuration, the conveyance path along which the recording medium P is conveyed from the recording medium storage section 50 to the recording medium discharge section 56 is configured by the first common path 34A, the recording medium conveyance path 34B, and the second common path 34D, and formed in a U shape as a whole. The conveyance path along which the original G is conveyed from the original storage section 16 to the original discharge section 32 is configured by the first common path 34A, the original conveyance path 34C, and the second common path 34D, and formed in a U shape as a whole. The original conveyance path 34C is disposed at the upstream side in the conveyance direction relative to the recording medium conveyance path 34B. The distance of the conveyance path of the original G is shorter than the distance of the conveyance path of the recording medium P and the conveyance path of the original G is turned back at the side short of the conveyance path of the recording medium P.

The conveyance path along which the original G is conveyed from the original storage section 16 to the original discharge section 32 may be configured by the first common path 34A, the recording medium conveyance path 34B, and the second common path 34D. In this case, all of the conveyance paths along which the original G and the recording medium P are conveyed are shared, and a conveyance path switching member 67 to be described in detail below does not need to be provided.

On the first common path 34A, the separation mechanism 30 is disposed at the downstream side in the conveyance direction of the feed roll 24. The separation mechanism 30 includes a conveyance roll 26 that applies a conveyance force to the original G and the recording medium P fed by the feed roll 24 from the front surface sides, and a separation pad 28 that applies conveyance resistance (friction resistance) to the original G and the recording medium P fed by the feed roll 24 from the rear surface sides.

Thus, when the plural originals G or recording media P are fed in an overlapped state by the feed roll 24, the conveyance roll 26 applies the conveyance force to the upper original G or recording medium P (first original G or recording medium P), while the separation pad 28 applies the conveyance resistance to the lower originals G or recording media P (second and following originals G or recording media P). As a result, the originals G or the recording media P that are fed in an overlapped state are separated. As such, the overlapped originals G or recording media P are separated and individually conveyed by the feed roll 24 and the separation pad 28.

On the first common path 34A, the conveyance roll 36 is disposed at the downstream side in the conveyance direction of the separation mechanism 30. The conveyance roll 36 is configured by a pair of rolls that nip the original G and the recording medium P and convey the original G and the recording medium P.

In the portion that is branched from the first common path 34A to the recording medium conveyance path 34B and the original conveyance path 34C, as an example of a conveyance path switching member that switches the conveyance path of the conveyance section 18 such that the conveying direction of the original G is turned back at the upstream side relative to that of the recording medium P, a conveyance path switching member 67 is provided.

As illustrated in FIG. 2, the conveyance path switching member 67 has a side 67A that forms a conveyance path surface of the original conveyance path 34C at the outer circumferential side, a top surface 67B that forms a conveyance path surface of the recording medium conveyance path 34B at the lower side, and a bottom surface 67C that forms a conveyance path surface of the recording medium conveyance path 34B at the upper side.

A lower portion of the conveyance path switching member 67 is rotatively supported onto the apparatus body 11 by a shaft portion 66. The conveyance path switching member 67 can move to a closed position (refer to FIG. 1) where the side 67A rotationally moves to a facing surface 69 side that the side 67A faces using the shaft portion 66 as the rotation center and closes the original conveyance path 34C, and an opened position (refer to FIG. 2) where the side 67A rotationally moves to the side separated from the facing surface 69 and opens the original conveyance path 34C.

When the conveyance path switching member 67 is positioned at the closed position, the recording medium conveyance path 34B is opened, and a conveyance path that includes the first common path 34A, the recording medium conveyance path 34B, and the second common path 34D is formed.

When the conveyance path switching member 67 is positioned at the opened position, the original conveyance path 34C is opened, and a conveyance path that includes the first common path 34A, the original conveyance path 34C, and the second common path 34D is formed. At this time, an upper end of the side 67A of the conveyance path switching member 67 protrudes upward to be higher than the lower path surface of the recording medium conveyance path 34B. Thereby, the original G that is conveyed along the first common path 34A bumps the side 67A and is guided to the original conveyance path 34C.

The conveyance path switching member 67 is configured to switch the conveyance path in linkage with the change in the position of the original storage section 16. A linkage mechanism includes a detector 45 serving as a detection member that is provided in the original storage section 16 and detects the position of the original storage section 16, and a driving motor 48 serving as the driving section that rotationally moves the conveyance path switching member 67, on the basis of the detection result of the detector 45.

As the detector 45, for example, a limit switch that is turned on when the limit switch is pushed by the side of the placing paten 22 of the original storage section 16 positioned at the contactable position and turned off when the original storage section 16 is positioned at the evacuation position is used. The configuration of the detector 45 is not limited to the above configuration. For example, the detector 45 may use a sensor, such as an optical sensor or the like, and may be any element that detects the position of the original storage section 16.

In the linkage mechanism, when the detector 45 detects that the original storage section 16 is positioned at the contactable position, the conveyance path switching member 67 rotationally moves to the opened position where the original conveyance path 34C is opened, by the driving motor 48. When the detector 45 detects that the original storage section 16 is positioned at the evacuation position, the conveyance path switching member 67 rotationally moves to the closed position where the original conveyance path 34C is closed, by the driving motor 48.

In the recording medium conveyance path 34B, an image forming unit 54 that forms an image on the recording medium P conveyed by the conveyance section 18, on the basis of an image read by the image reading unit 20 to be described in detail below, is provided.

The image forming unit 54 includes an inkjet recording head 53 that ejects ink droplets from nozzles and forms an image on the recording medium P. The inkjet recording head 53 ejects the ink droplets to the recording medium P conveyed to an image formation position below the inkjet recording head 53 and records an image.

An ink storage section 55 that stores the ink supplied to the inkjet recording head 53 is provided to be adjacent to the inkjet recording head 53.

Below the inkjet recording head 53, a maintenance member 57 that maintains the inkjet recording head 53 is provided to face an ejection surface. The maintenance member 57 has a cap that covers the ejection surface, a cleaning member that cleans the ejection surface of the inkjet recording head 53, and a sucking device that sucks the ink in the nozzles.

The configuration of the image forming unit 54 is not limited to the configuration including the inkjet recording head 53. For example, the image forming unit 54 may be an image forming unit that forms an image using an electrophotographic system, and all of the configurations other than the configuration including the inkjet recording head that can form an image may be used.

In the recording medium conveyance path 34B, the conveyance roll 36 is disposed at the upstream and downstream sides in the conveyance direction of the image forming unit 54 with the image forming unit 54 provided therebetween. The conveyance roll 36 is configured by a pair of rolls that nip the original G and the recording medium P and convey the original G and the recording medium P, and conveys the recording medium with the upstream and downstream sides of the conveyance direction of the recording medium P passing through the image formation position of the image forming unit 54 nipped therebetween.

On the original conveyance path 34C, the image reading unit 20 that reads an image of the original G conveyed by the conveyance section 18 is provided. The image reading unit 20 is configured to include a light source (not illustrated), an optical system (not illustrated), such as a mirror or an imaging lens, and an image reading element (not illustrated) composed of a CCD or the like.

A transparent member 38, such as a glass plate, which passes light irradiated from the light source of the image reading unit 20, is provided on the original conveyance path 34C. The transparent member 38 forms a conveyance path surface of the original conveyance path 34C, and a position where the transparent member 38 is disposed becomes an image reading position where an image of the original conveyed along the original conveyance path 34C is read.

By the above configuration, the light is irradiated onto the original G conveyed along the original conveyance path 34C from the light source of the image reading unit 20, reflection light that is reflected on the original is guided to the image reading element through the optical system, and an image is read by the image reading element. At this time, the image reading unit 20 is positioned at the predetermined position and fixed, below the transparent member 38. As such, if the original G is conveyed by the conveyance section 18, the original G is slow-scanned (sub-scanned) with respect to the image reading unit 20 and an image of the original G is read.

A controller (not illustrated) is connected to the image reading unit 20. The controller converts the image read by the image reading unit 20 into an image signal, and transmits the converted image signal to the image forming unit 54.

The configuration of the image reading unit 20 is not limited to the above configuration. For example, the image reading unit 20 may be an adhesive-type image sensor that irradiates light emitted from a light emitting portion, such as a light emitting diode, onto the original, receives reflected light, and optically reads an image of the original, and may be any device that can read an image.

In the second common path 34D, the conveyance roll 36 is disposed at the upstream and downstream sides of the conveyance direction of the image reading unit 20 with the image forming unit 20 located therebetween. The conveyance roll 36 is composed of a pair of rolls that convey the original G and the recording medium P with the original G and the recording medium P nipped therebetween, and nips the upstream and downstream sides of the conveyance direction of the recording medium P passing through the image reading position and conveys the recording medium P.

The conveyance roll 36 that is disposed at the upstream side in the conveyance direction of the image reading unit 20 is disposed on a portion where the original conveyance path 34C and the recording medium conveyance path 34B join with each other.

In the second common path 34D, as an example of a discharge member that can discharge the original G and the recording medium P conveyed from the conveyance section 18 to the original discharge section 32 and the recording medium discharge section 56, a discharge roll 39 is provided at the downstream side in the conveyance direction of the conveyance section 18 relative to the conveyance roll 36 at the downstream side.

At the side of the discharge direction of the discharge roll 39, as an example of a discharge destination switching member that switches a discharge destination by the discharge roll 39 from one of the original discharge section 32 and the recording medium discharge section 56 to the other, a discharge destination switching member 70 is provided. The discharge destination switching member 70 forms a portion of a placing platen 42 of the original discharge section 32 and places the original G on a top surface thereof.

In the discharge destination switching member 70, the downstream side in the discharge direction is rotatively supported onto the apparatus body 11 by a shaft portion 73. The discharge destination switching member 70 can move to a closed position where the upstream-side end rotationally moves upward using the shaft portion 73 as the rotation center and closes the original discharge section 32, and an opened position where the upstream-side end rotationally moves downward and opens the original discharge section 32.

When the discharge destination switching member 70 is positioned at the closed position, the recording medium discharge section 56 is opened, and the original G or the recording medium P that is discharged by the discharge roll 39 can be discharged to the recording medium discharge section 56.

When the discharge destination switching member 70 is positioned at the opened position, the original discharge section 32 is opened, and the original G or the recording medium P that is discharged by the discharge roll 39 can be discharged to the original discharge section 32.

The discharge destination switching member 70 is configured to switch the discharge destination of the discharge roll 39 in linkage with the change in the position of the original storage section 16. The linkage mechanism includes the detector 45 and a driving motor 46 serving as a driving section that rotationally moves the discharge destination switching member 70, on the basis of the detection result of the detector 45.

According to the linkage mechanism, if the detector 45 detects that the original storage section 16 is positioned at the contactable position, the discharge destination switching member 70 rotationally moves to the opened position where the original discharge section 32 is opened, by the driving motor 46. If the detector 45 detects that the original storage section 16 is positioned at the evacuation position, the conveyance path switching member 67 rotationally moves to the closed position where the original discharge section 32 is closed, by the driving motor 46.

The reversion path 34E is configured such that the original G from which an image of one surface has been read by the image reading unit 20 in a case where images of both surfaces are to be read is reversed by the discharge roll 39, guided to the reversion path 34E, passes through the first common path 34A and the original conveyance path 34C, and is returned to the image reading position. The reversion path 34E is configured such that the recording medium P on which an image has been formed on one surface by the image forming unit 54 in a case where when images are to be formed on both surfaces is reversed by the discharge roll 39, guided to the reversion path 34E, passes through the first common path 34A and the recording medium conveyance path 34B, and is returned to the image forming position.

Operation of the Image Forming Apparatus According to this Exemplary Embodiment

Next, an operation of the image forming apparatus according to this exemplary embodiment will be described. Here, the case where an image of the original G is copied to the recording medium P is exemplified.

First, an operator who operates an image forming apparatus 10 stores the recording medium P in the recording medium storage section 50 and stores the original G in the original storage section 16. If the original G is stored in the original storage section 16, the detector 47 detects the original G.

Figure 5:
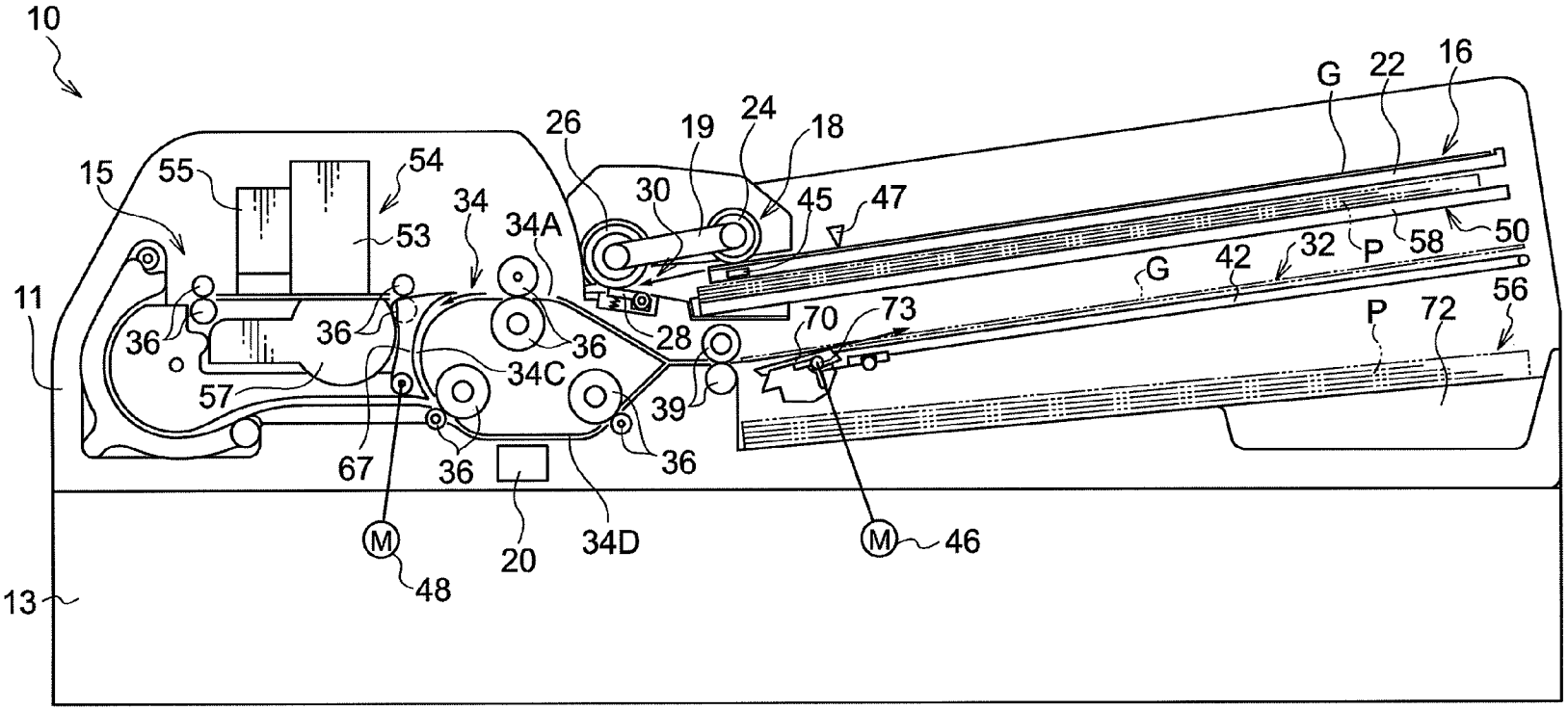
FIG. 5 is a schematic diagram illustrating a state of the case where the original is conveyed in the image forming apparatus according to the exemplary embodiment of the present invention.

Meanwhile, the detector 45 detects the position of the original storage section 16. The detector 45 detects that the original storage section 16 is positioned at the evacuation position where the feed roll 24 does not contact the stored original G, and the detector 47 detects that the original G is stored. In this case, as illustrated in FIG. 5, the original storage section 16 is moved to the contactable position where the feed roll 24 can contact the stored original by the movement mechanism 49.

If the original storage section 16 moves to the contactable position, the detector 45 detects that the original storage section 16 is positioned at the contactable position. The conveyance path switching member 67 moves to the opened position where the original conveyance path 34C is opened by the driving motor 48, on the basis of the detection result, and a conveyance path that includes the first common path 34A, the original conveyance path 34C, and the second common path 34D is formed. On the basis of the detection result of the detector 45 indicating that the original storage section 16 is positioned at the contactable position, the discharge destination switching member 70 moves to the opened position where the original discharge section 32 is opened by the driving motor 46, and the discharge destination of the original G from the discharge roll 39 becomes the original discharge section 32.

If the operator operates the operation section and the copy operation starts, first, the feed roll 24 rotationally moves to the contact position where the feed roll 24 contacts the original G stored in the original storage section 16. The original G that the feed roll 24 has contacted is fed from the original storage section 16 by the feed roll 24.

The original G that is fed from the original storage section 16 is conveyed along the first common path 34A, passes through the separation mechanism 30, and is guided to the original conveyance path 34C. The original G that is guided to the original conveyance path 34C passes through the original conveyance path 34C and is conveyed along the second common path 34D. An image of the original G that is conveyed along the second common path 34D is read by the image reading unit 20, and the original G is discharged to the original discharge section 32 by the discharge roll 39.

Figure 6:
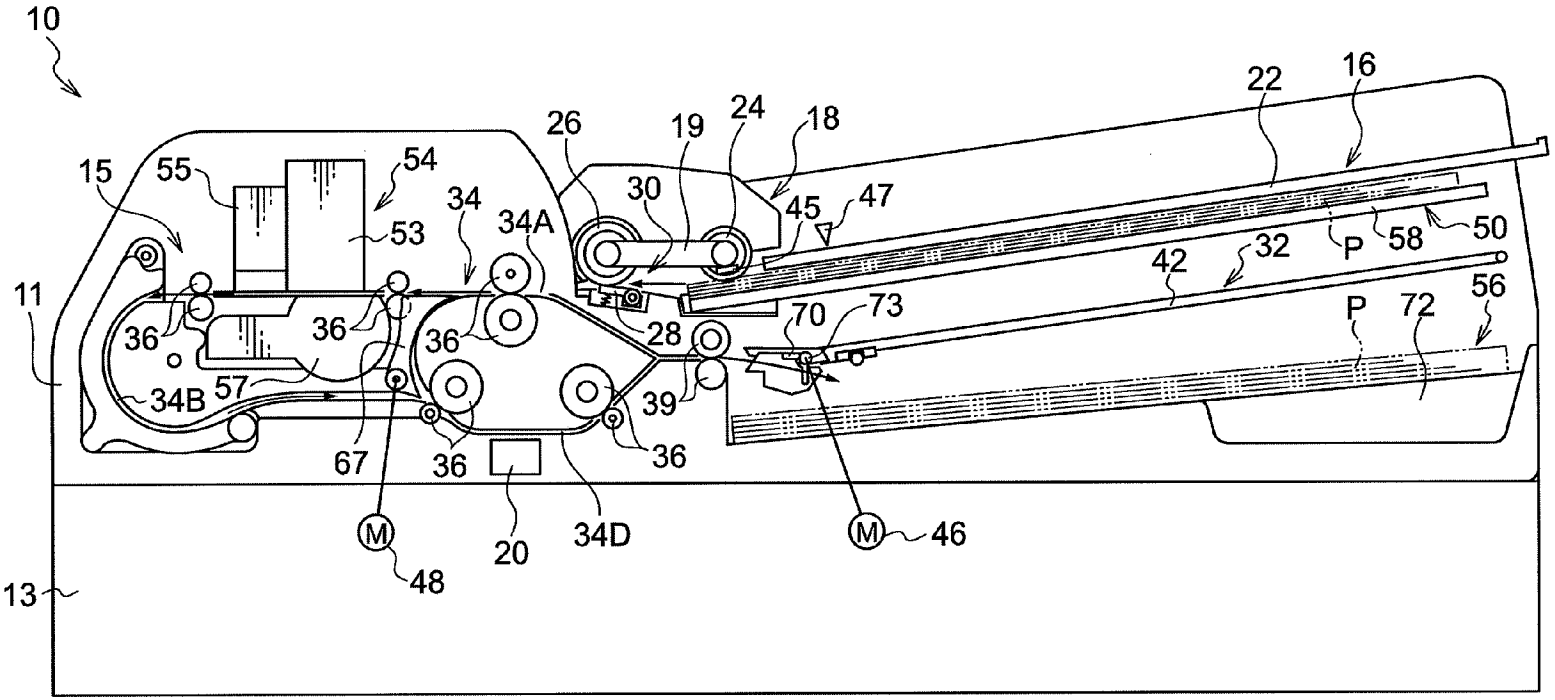
FIG. 6 is a schematic diagram illustrating a state of the case where the recording medium is conveyed in the image forming apparatus according to the exemplary embodiment of the present invention.

If the original G that is stored in the original storage section 16 is fed, the detector 47 detects that the original G does not exist in the original storage section 16. Based on this detection result, as illustrated in FIG. 6, the original storage section 16 moves to the evacuation position by the movement mechanism 49.

If the original storage section 16 moves to the evacuation position, the detector 45 detects that the original storage section 16 is positioned at the evacuation position. Based on the detection result, the conveyance path switching member 67 moves to the closed position where the original conveyance path 34 is closed by the driving motor 48, and a conveyance path that includes the first common path 34A, the recording medium conveyance path 34B, and the second common path 34D is formed. When the detection result of the detector 45 indicates that the original storage section 16 is positioned at the evacuation position, the discharge destination switching member 70 moves to the closed position where the original discharge section 32 is closed by the driving motor 46, and the discharge destination of the recording medium P by the discharge roll 39 becomes the recording medium discharge section 56.

The feed roll 24 rotationally moves to the contact position where the feed roll 24 contacts the recording medium P stored in the recording medium storage section 50, by the rotation of the feed roll 26. The recording medium P that the feed roll 24 has contacted is fed from the recording medium storage section 50 by the feed roll 24.

The recording medium P that is fed from the recording medium storage section 50 is conveyed along the first common path 34A, passes through the separation mechanism 30, and is guided to the recording medium conveyance path 34B. In the recording medium P that is guided to the recording medium conveyance path 34B, an image based on the image read by the image reading unit 20 is formed by the image forming unit 54.

The recording medium P where the image is formed is conveyed along the recording medium conveyance path 34B and the second common path 34D, and is discharged to the recording medium discharge section 56 by the discharge roll 39.

As described above, in this exemplary embodiment, the conveyance path along which the original G and the recording medium P are conveyed and the discharge destination to which the original G and the recording medium P are discharged are determined according to the position of the original storage section 16, and the operation to separately select the conveyance path and the discharge destination becomes unnecessary.

The configuration of the linkage mechanism that switches the conveyance path in linkage with the change in the position of the original storage section 16 and the linkage mechanism that switches the discharge destination from the discharge roll 39 in linkage with the change in the position of the original storage section 16 is not limited to the above configuration. For example, the following configuration may be used.

Figure 3:
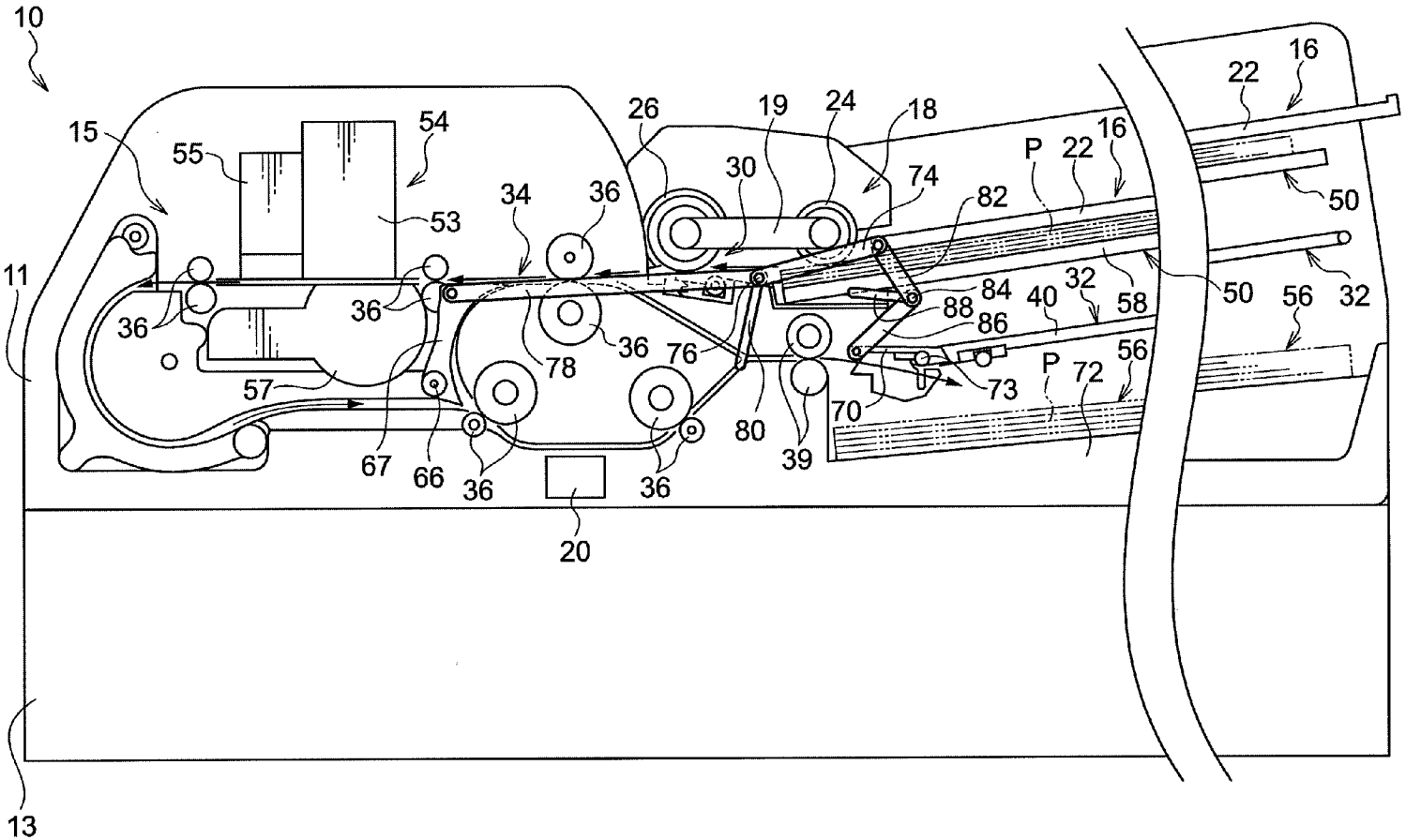
FIG. 3 is a schematic diagram illustrating a state of the case where a recording medium is conveyed, in the configuration of the image forming apparatus according to the exemplary embodiment of the present invention in which a moving force of an original storage section whose position has changed is transmitted to a conveyance path switching member and a discharge destination switching member and the conveyance path switching member and the discharge destination switching member are moved.
Figure 4:
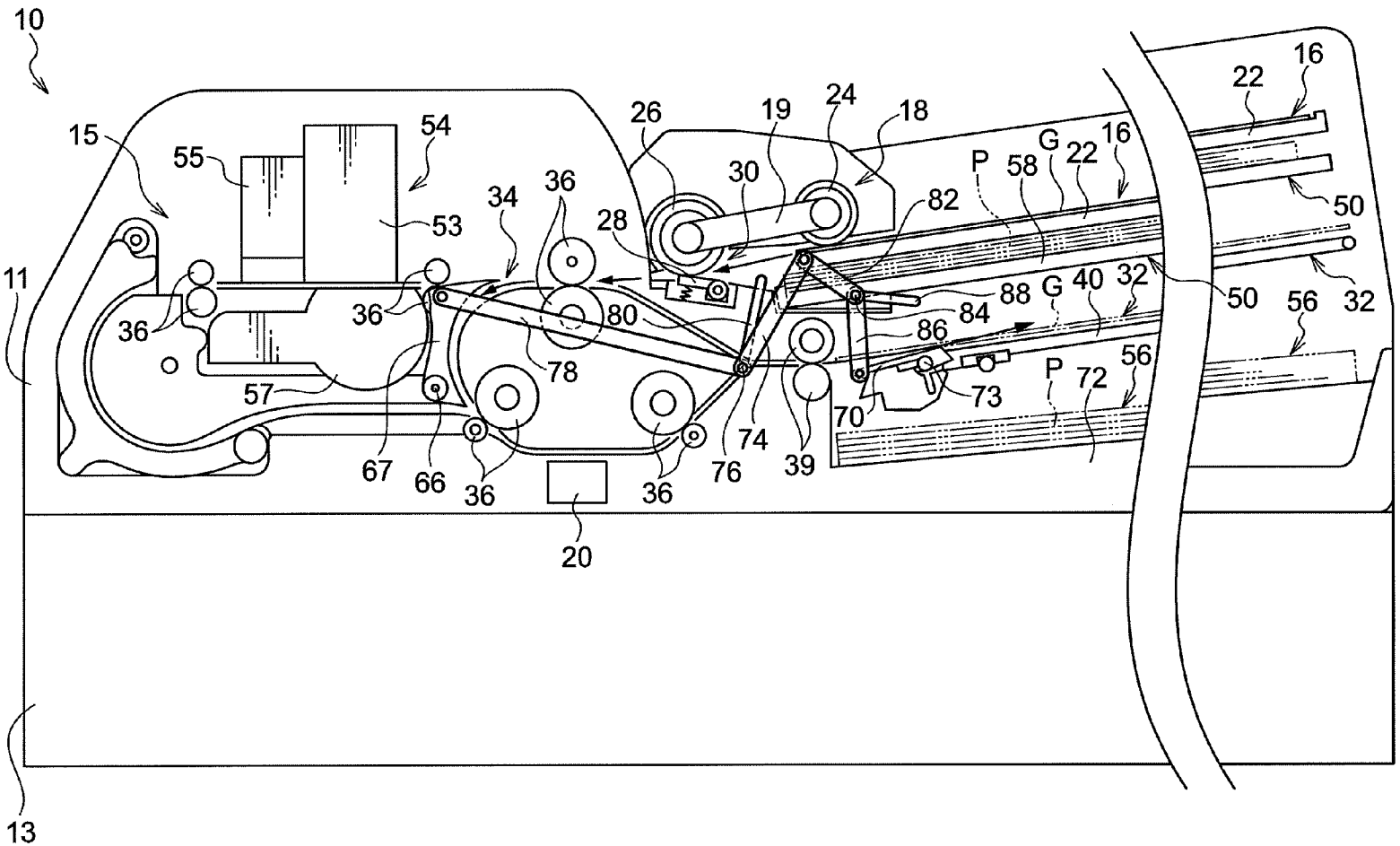
FIG. 4 is a schematic diagram illustrating a state of the case where the original is conveyed in the configuration illustrated in FIG. 3.

As illustrated in FIGS. 3 and 4, a linkage mechanism that switches a conveyance path includes a first connecting member 74 that has one end portion thereof rotatively mounted onto each side of the placing platen 22 at the front end side in the feed direction, a second connecting member 78 that has one end portion rotatively mounted onto the other end of the first connecting member 74 by the shaft portion 76 and the other end portion mounted onto the conveyance path switching member 67, and a guide member (not illustrated) that has an elongated hole 80 through which the shaft portion 76 is guided.

In this configuration, the shaft portion 76 can move from one end of the elongated hole 80 to the other end, and the position in which the elongated hole 80 is formed is adjusted as follows. If the original storage section 16 moves to the evacuation position, as illustrated in FIG. 3, the first connecting member 74 is pulled, and the shaft portion 76 moves to one end (upper end) of the elongated hole 80. If the original storage section 16 moves to the contactable position, as illustrated in FIG. 4, the first connecting member 74 is pushed and the shaft portion 76 moves to the other end (lower end) of the elongated hole 80.

If the shaft portion 76 moves to one end (upper end) of the elongated hole 80, as illustrated in FIG. 3, the second connecting member 78 is pulled, and the conveyance path switching member 67 moves to the closed position. If the shaft portion 76 moves to the other end (lower end) of the elongated hole 80, as illustrated in FIG. 4, the second connecting member 78 is pushed, and the conveyance path switching member 67 moves to the opened position.

As illustrated in FIGS. 3 and 4, a linkage mechanism that switches the discharge destination of the discharge roll 39 includes a third connecting member 82 that has one end portion rotatively mounted onto each side of the placing platen 22 at the front end side in the feed direction, a fourth connecting member 86 that has one end portion rotatively mounted onto the other end portion of the third connecting member 82 by the shaft portion 84 and the other end portion mounted onto the upstream side end of the discharge destination switching member 70, and a guide member (not illustrated) that has an elongated hole 88 through which the shaft portion 84 is guided.

In this configuration, the shaft portion 84 can move from one end of the elongated hole 88 to the other end, and the position in which the elongated hole 88 is formed is adjusted as follows. When the original storage section 16 moves to the evacuation position, as illustrated in FIG. 3, the third connecting member 82 is pulled, and the shaft portion 84 moves to one end (right end in FIG. 3) of the elongated hole 88. Then, the original storage section 16 moves to the contactable position. Consequently, as illustrated in FIG. 4, the third connecting member 82 is pushed and the shaft portion 84 moves to the other end (left end in FIG. 4) of the elongated hole 88.

With the movement of the shaft portion 84 to one end (right end in FIG. 3) of the elongated hole 88, as illustrated in FIG. 3, the fourth connecting member 86 is pulled, and the discharge destination switching member 70 moves to the closed position. If the shaft portion 84 moves to the other end (left end in FIG. 3) of the elongated hole 88, as illustrated in FIG. 4, the fourth connecting member 86 is pushed, and the discharge destination switching member 70 moves to the opened position.

As such, the moving force of the original storage section 16 whose position has changed may be transmitted to the conveyance path switching member 67 and the discharge destination switching member 70, and allows the conveyance path switching member 67 and the discharge destination switching member 70 to be moved. The configuration is not limited to the above configuration, and the configuration for linkage using different mechanical elements, such as a cam, may be used.

In the above configuration, on the basis of the detection result of the detector 47 indicating that the original G is stored, the original storage section 16 is moved to the contactable position by the movement mechanism 49. If the detector 45 detects that the original storage section 16 is positioned at the contactable position, on the basis of the detection result, the conveyance path switching member 67 is moved to the opened position by the driving motor 48, and the discharge destination switching member 70 is moved to the opened position by the driving motor 46. However, configuration may be such that the original storage section 16 may be moved to the contactable position by the movement mechanism 49, the conveyance path switching member 67 may be moved to the opened position by the driving motor 48, and the discharge destination switching member 70 may be moved to the opened position by the driving motor 46, on the basis of the detection result of the detector 47 indicating that the original G is stored.

That is, different from the configuration where the conveyance path switching member 67 and the discharge destination switching member 70 are moved to the opened position in linkage with the change in the position of the original storage section 16, in this configuration, on the basis of the operator intention for the original G to be stored in the original storage section 16, and conveyed independently from the change in the position of the original storage section 16 (that is, moved immediately according to the detection of the original G), the conveyance path switching member 67 and the discharge destination switching member 70 are moved to the opened position. In this configuration, the detector 45 does not need to be provided.

In the above configuration, on the basis of the detection result of the detector 47 indicating that the original G is not stored, the original storage section 16 is moved to the evacuation position by the movement mechanism 49. If the detector 45 detects that the original storage section 16 is positioned at the evacuation position, based on the detection result, the conveyance path switching member 67 is moved to the closed position by the driving motor 48, and the discharge destination switching member 70 is moved to the closed position by the driving motor 46. However, based on the detection result of the detector 47 indicating that the original G is not stored, the original storage section 16 may be moved to the evacuation position by the movement mechanism 49, the conveyance path switching member 67 may be moved to the closed position by the driving motor 48, and the discharge destination switching member 70 may be moved to the closed position by the driving motor 46.

That is, rather than the configuration where the conveyance path switching member 67 and the discharge destination switching member 70 are moved to the closed position in linkage with the change in the position of the original storage section 16, in this configuration, on the basis of the operator intention for the original G represented by not storing the original G in the original storage section 16, independently from the change in the position of the original storage section 16, the conveyance path switching member 67 and the discharge destination switching member 70 are moved to the closed position.

The original storage section 16 may be moved by the movement mechanism 49, on the basis of a copy instruction (similarly to an image read instruction, an image formation instruction or the like) that is generated when the operator operates the operation section and causes the image of the original G to be copied to the recording medium P.

Even in a configuration such that the original storage section 16 is moved by the movement mechanism 49 on the basis of the copy instruction, the position of the original storage section 16 may be detected by the detector 45, the conveyance path switching member 67 may be moved by the driving motor 48 on the basis of the detection result, and the discharge destination switching member 70 may be moved by the driving motor 46.

Even in a configuration such that the original storage section 16 is moved by the movement mechanism 49 on the basis of the copy instruction, on the basis of the copy instruction, the original storage section 16 may be moved by the movement mechanism 49, the conveyance path switching member 67 may be moved by the driving motor 48, and the discharge destination switching member 70 may be moved by the driving motor 46. That is, different from the configuration such that the conveyance path switching member 67 and the discharge destination switching member 70 are moved in linkage with the change in the position of the original storage section 16, in this configuration, on the basis of the operation at the operation section, independently from the change in the position of the original storage section 16, the conveyance path switching member 67 and the discharge destination switching member 70 are moved. In this configuration, the detector 45 does not need to be provided.

Even in such a configuration that the original storage section 16 is moved by the movement mechanism 49 on the basis of the copy instruction, the linkage mechanism where the moving force of the original storage section 16 whose position has changed may be transmitted to the conveyance path switching member 67 and the discharge destination switching member 70 to move the conveyance path switching member 67 and the discharge destination switching member 70 may be adopted.

The position of the original storage section 16 may be manually changed. Even in this configuration, the position of the original storage section 16 may be detected by the detector 45. On the basis of the detection result, the conveyance path switching member 67 may be moved by the driving motor 48, and the discharge destination switching member 70 may be moved by the driving motor 46.

Even in the configuration such that the position of the original storage section 16 is manually changed, the linkage mechanism where the moving force of the original storage section 16 whose position has changed may be transmitted to the conveyance path switching member 67 and the discharge destination switching member 70 to move the conveyance path switching member 67 and the discharge destination switching member 70 may be adopted. In this configuration, the movement mechanism 49 and the detector 47 do not need to be provided.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A conveyance mechanism comprising:

a first storage section that stores an original;

a second storage section that stores a recording material;

a first discharge section;

a second discharge section;

a conveyance section that conveys the original from the first storage section via a first path and conveys the recording material from the second storage section via a second path; and a discharge member that discharges the original conveyed from the first storage section to the first discharge section and discharges the recording material conveyed from the second storage section to the second discharge section, wherein a first portion of the second path is a portion in common with the first path and a second portion of the second path is separated from the first path, and an image forming unit is disposed on the second portion of the second path, and an image reading unit is disposed on the first portion of the second path.

2. The conveyance mechanism according to claim 1, wherein the first storage section, the second storage section, the first discharge section, and the second discharge section are disposed on one side with respect to the conveyance section.

3. The conveyance mechanism according to claim 1, further comprising a detector that detects a position of the first storage section, wherein the discharge member switches the discharge destination on the basis of the detection result of the detector.

4. An image forming apparatus comprising:

the conveyance mechanism according to claim 1;

wherein the image reading unit reads an image of the original conveyed by the conveyance mechanism; and the image forming unit forms an image on the recording material conveyed by the conveyance mechanism, on the basis of the image read by the image reading unit.

5. A conveyance mechanism according to claim 1, further comprising:

a movement mechanism that moves the first storage section between a first position and a second position, wherein the discharge member switches the discharge destination, in response to movement by the movement section of the first storage section from the first position to the second position, or vice versa.

6. The conveyance mechanism according to claim 5, wherein the conveyance section comprises a feed member that is adapted to selectively feed the original from the first storage section, or the recording material from the second storage section to the portion in common, according to a position of the first storage section.

7. The conveyance mechanism according to claim 5, wherein the movement mechanism moves the first storage section between the first position and the second position, according to whether the original is present in the first storage section, or the recording material is present in the second storage section.

8. The conveyance mechanism according to claim 5, further comprising a conveyance path switch that switches between the first path and the second path, according to whether the original is present in the first storage section, or the recording material is present in the second storage section.

9. The conveyance mechanism according to claim 5, wherein the discharge member switches the discharge destination, according to whether the original is present in the first storage section, or the recording material is present in the second storage section.

10. A conveyance mechanism comprising:

a first storage section that stores an original;

a second storage section that stores a recording material;

a first discharge section;

a second discharge section;

a conveyance section that conveys the original from the first storage section via a first path and conveys the recording material from the second storage section via a second path;

a discharge member that discharges the original conveyed from the first storage section to the first discharge section and discharges the recording material conveyed from the second storage section to the second discharge section;

a movement mechanism that moves the first storage section, according to a kind of the conveyed material; and a discharge switch that switches the discharge destination to the first discharge section and to the second discharge section, wherein a first portion of the second path is in common with the first path and a second portion of the second path is separated from the first path, and an image forming unit is disposed on the second portion of the second path, and an image reading unit is disposed on the first portion of the second path.

11. The conveyance mechanism according to claim 10, wherein the first storage section, the second storage section, the first discharge section, and the second discharge section are disposed on one side with respect to the conveyance section.

12. A conveyance mechanism comprising:

a first storage section that stores an original;

a second storage section that stores a recording material;

a first discharge section;

a second discharge section;

a conveyance section that conveys the original from the first storage section via a first path and conveys the recording material from the second storage section via a second path;

a discharge member that is discharges the original conveyed from the first storage section to the first discharge section and discharges the recording material conveyed from the second storage section to the second discharge section; and a discharge switch that switches the discharge destination to the first discharge section and to the second discharge section, wherein a first portion of the second path is a portion in common with the first path and a second portion of the second path is separated from the first path, and an image forming section is disposed on the second portion of the second path, and an image reading unit is disposed on the first portion of the second path, and wherein the first storage section, the second storage section, the first discharge section, and the second discharge section are stacked and aligned in a vertical direction.

13. An image forming apparatus comprising:

a conveyance mechanism comprising:

an first storage section that stores an original;

a second storage section that stores a recording material;

a first discharge section;

a second discharge section;

a conveyance section that conveys the original from the first storage section via a first path and conveys the recording material from the second storage section via a second path;

a discharge member that is discharges the original conveyed from the first storage section to the first discharge section and discharges the recording material conveyed from the second storage section to the second discharge section; and a discharge switch that switches the discharge destination to the first discharge section and to the second discharge section, wherein a first portion of the second path is a portion in common with the first path and a second portion of the second path is separated from the first path, and an image forming section is disposed on the second portion of the second path, and an image reading unit is disposed on the first portion of the second path, and wherein the first storage section, the second storage section, the first discharge section, and the second discharge section are located on a same side of the image forming apparatus.

* * * * *